US007866329B2

(12) United States Patent
Bates

(10) Patent No.: US 7,866,329 B2
(45) Date of Patent: Jan. 11, 2011

(54) APPARATUS FOR CLEANING PAINT ROLLERS

(76) Inventor: Jonathan L. Bates, 5007 66th Ave. NE., Marysville, WA (US) 98270

( * ) Notice: Subject to any disclaimer, the term of this patent is extended or adjusted under 35 U.S.C. 154(b) by 721 days.

(21) Appl. No.: 11/982,525

(22) Filed: Nov. 2, 2007

(65) Prior Publication Data

US 2008/0105284 A1 May 8, 2008

Related U.S. Application Data

(60) Provisional application No. 60/856,465, filed on Nov. 3, 2006.

(51) Int. Cl.
*B08B 3/00* (2006.01)

(52) U.S. Cl. ..... 134/138; 134/198; 134/900

(58) Field of Classification Search ..... 134/138, 134/198, 900
See application file for complete search history.

(56) References Cited

U.S. PATENT DOCUMENTS

| | | | | |
|---|---|---|---|---|
| 2,831,488 | A | 4/1958 | Anderson | |
| 2,938,368 | A | 5/1960 | Bixel | |
| 3,133,548 | A | 5/1964 | Carr | |
| 3,688,785 | A * | 9/1972 | Stevens et al. | 134/138 |
| 3,730,195 | A | 5/1973 | Kay | |
| 3,755,840 | A | 9/1973 | Barger | |
| 3,886,960 | A | 6/1975 | Krueger | |
| 3,897,797 | A * | 8/1975 | Wright et al. | 134/113 |
| 3,901,256 | A * | 8/1975 | Habostad | 134/138 |
| 4,061,153 | A | 12/1977 | Doherty | |
| 4,130,124 | A | 12/1978 | Sherwin | |
| 4,311,158 | A | 1/1982 | Harvey | |
| 4,446,590 | A | 5/1984 | Kirchner, Jr. et al. | |
| 4,641,673 | A | 2/1987 | Conley et al. | |
| 4,672,987 | A * | 6/1987 | Brandt | 134/138 |
| 4,700,728 | A | 10/1987 | Patterson | |
| 4,708,152 | A | 11/1987 | Hibberd | |
| 4,733,679 | A | 3/1988 | Dolcater | |
| 4,832,066 | A | 5/1989 | Shipman | |
| 5,005,598 | A | 4/1991 | Hodgdon | |
| 5,050,626 | A | 9/1991 | Brockage et al. | |
| 5,095,928 | A | 3/1992 | Phipps | |
| 5,337,769 | A | 8/1994 | Howe | |
| 5,363,869 | A | 11/1994 | McDowell | |
| D354,438 | S | 1/1995 | Miller | |
| 5,409,027 | A | 4/1995 | Glunt | |
| 5,413,133 | A | 5/1995 | Russell | |
| 5,487,399 | A | 1/1996 | Hannah | |
| 5,505,220 | A * | 4/1996 | Gorecki | 134/138 |
| 5,743,425 | A | 4/1998 | Ellis | |
| 5,816,275 | A | 10/1998 | Mullen | |
| 5,839,459 | A * | 11/1998 | Bisby | 134/138 |

(Continued)

*Primary Examiner*—Michael Barr
*Assistant Examiner*—Jason Heckert
(74) *Attorney, Agent, or Firm*—Todd N. Hathaway

(57) ABSTRACT

A roller cleaning apparatus for cleaning and/or drying a roller such as a paint roller by directing jets of solvent against the surface of the roller—to spin the roller to expel liquid from the roller by centrifugal force. A jet spray manifold with a riser conduit connector for connection to a source of pressure fluid is mounted on the bottom side of a lid structure. A roller to be cleaned is also mounted to the bottom side of the lid structure in position for spinning and cleaning. The lid structure may be mounted on a standard paint bucket or other support.

17 Claims, 7 Drawing Sheets

U.S. PATENT DOCUMENTS 6,019,111 A * 2/2000 Gillies ..... 134/138
6,450,185 B1 9/2002 Sallinen
D467,049 S 12/2002 Kohn
D480,968 S 10/2003 Atkins et al.
D485,955 S 1/2004 Johnson
6,783,019 B2 8/2004 Zettle et al.
7,640,941 B2 * 1/2010 Watters et al. ..... 134/138
2003/0177597 A1 9/2003 Wallace, III
2004/0003835 A1 * 1/2004 Higgins ..... 134/138
2007/0089765 A1 4/2007 Clark
2008/0035185 A1 * 2/2008 Baratta ..... 134/137
2008/0078429 A1 * 4/2008 Hoffmann ..... 134/178

* cited by examiner

APPARATUS FOR CLEANING PAINT ROLLERS

CROSS REFERENCE TO RELATED APPLICATIONS

This application claims the benefit under 35 U.S.C. 119(e), of U.S. Provisional Patent Application Ser. No. 60/856,465 Filed Nov. 3, 2006.

BACKGROUND

1. Field of the Invention

The present invention relates generally to apparatus for removing paint or other material from a standard roller type applicator. More particularly, a roller, rotatably mounted on a handle, is held stationary while one or more fluid jets of solvent are impacted against the roller surface causing it to spin at a relatively high speed resulting in the removal of diluted material from the roller by the centrifugal force generated.

2. Description of the Prior Art

The prior art contains many paint roller cleaning systems which utilize one or more solvent jets to impact a roller for the purpose of spinning the roller and diluting the paint which is then thrown off from the roller by centrifugal force. These systems usually include apparatus for supporting the paint roller or the roller cover itself within a container and producing a spray of solvent from an outside source, usually through a manifold of multiple spray nozzles to clean the roller. The rollers or roller covers may be mounted either horizontally within a bucket or other container such as shown in U.S. Pat. No. 5,816,275 to Mullen and U.S. Pat. No. 3,901,256 to Habostad with the roller extending either horizontally or vertically as shown in U.S. Pat. No. 4,708,152 to Hibberd. The roller or roller and handle may be hand held and extend within the bucket or mounted on a support structure within the container. In some instances, a single jet of solvent is hand manipulated along the length of the roller such as shown in the Habostad U.S. Pat. Nos. 3,901,256, and 5,337,769 to Howe to provide a tangential force to spin the roller. When a bucket or other container is used to mount the roller, the paint or other material laden solvent is usually collected in the container. Still other embodiments use a tubular shield or the like, such as shown in U.S. Pat. No. 5,005,598 to Hodgdon, with discharge openings to allow the paint laden solvent to drain directly into a discharge system. Many of the prior art roller spinning cleaners require specialized containers or housings, which are complex mechanical devices, to surround the spinning roll. These devices, especially when requiring hand operated spray systems or roller positioning structures, are often messy because of spilling and splashing during the cleaning operation. The need thus arises for an efficient and compact single apparatus for holding a standard roller and handle in juxtaposition to a pressurized solvent jet spray which can be easily connected to an external source of solvent such as a water pressure source when dealing with water soluble paints.

SUMMARY OF THE EMBODIMENTS

A container lid may be formed by injection molding or any number of known manufacturing methods and configured so as to engage the top rim of a standard bucket such as a five gallon paint bucket utilized for commercial or household purposes. The lid will be formed with a continuous peripheral channel suitable for receiving the bucket rim. Alternatively, the lid structure may be configured so as to engage the top rim of any particular container or other support as will be evident from the present description. In one embodiment, the lid provides a raised portion on its surface forming an elongated domed housing or mounting area for a jet spray manifold with a fluid connection suitable for connecting to a source of water or other solvent under pressure. In some instances, compressed air may be used to fluff dry the roller. An alternate embodiment is also disclosed which provides a fitting for connecting a riser conduit in the body of the lid structure with the manifold being located directly on the inside or under surface of the lid. A paint roller and handle mounting structure for releasably securing a paint roller to the underside of the lid is provided. The roller mounting structure is releasably locked to the lid structure and positions the roller so as to be contacted by the solvent jet spray from the manifold. A locking mechanism connects the mounting structure to the lid and conforms the surface of the mounting structure to the surface configuration of the lid. Alternately, the roller/handle mounting structure may take the form of a clamping mechanism which clamps the roller handle to a mounting platform formed on the inside or bottom surface of the lid. The manifold is provided with orifices capable of directing jets or a fan of jets of pressurized fluid solvent against the surface of the roller in such a manner as to rapidly spin the roller for cleaning and/or drying the roller by spinning off the paint laden solvent by centrifugal force. The paint laden solvent may be either collected in the bucket for disposal or may be allowed to drain directly into a discharge system. A standard paint roller and handle, as well as the solvent spray manifold and its pressure fluid connector, may all be incorporated directly into the lid assembly. The roller and its handle are conveniently clamped in position for cleaning and released for removing from the lid assembly following the cleaning operation.

DETAILED DESCRIPTION OF THE PREFERRED EMBODIMENTS

Figure 1A:
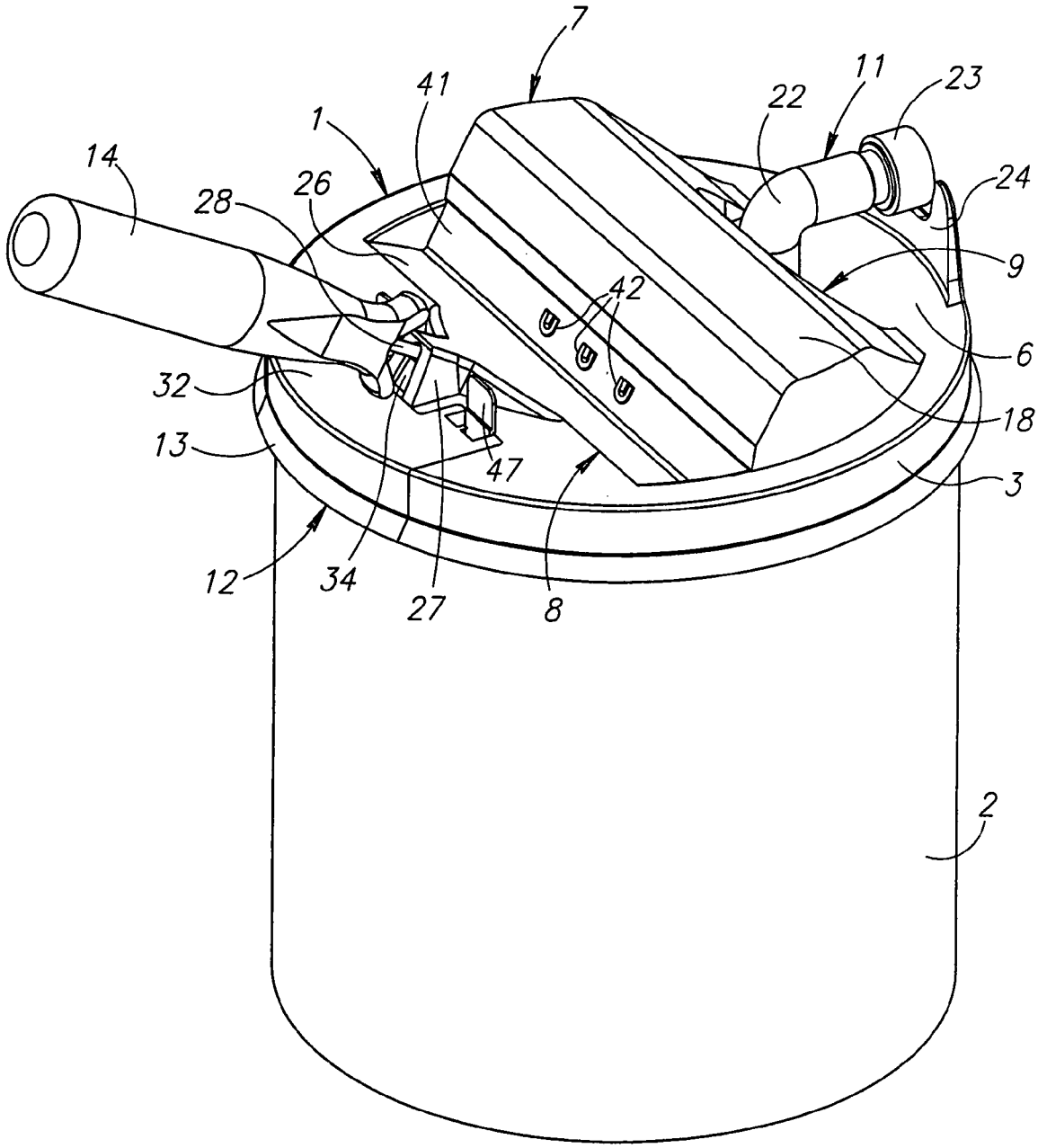
FIG. 1A is an isometric view of a first embodiment of the assembled paint roller cleaning apparatus mounted on a standard paint bucket.
Figure 1B:
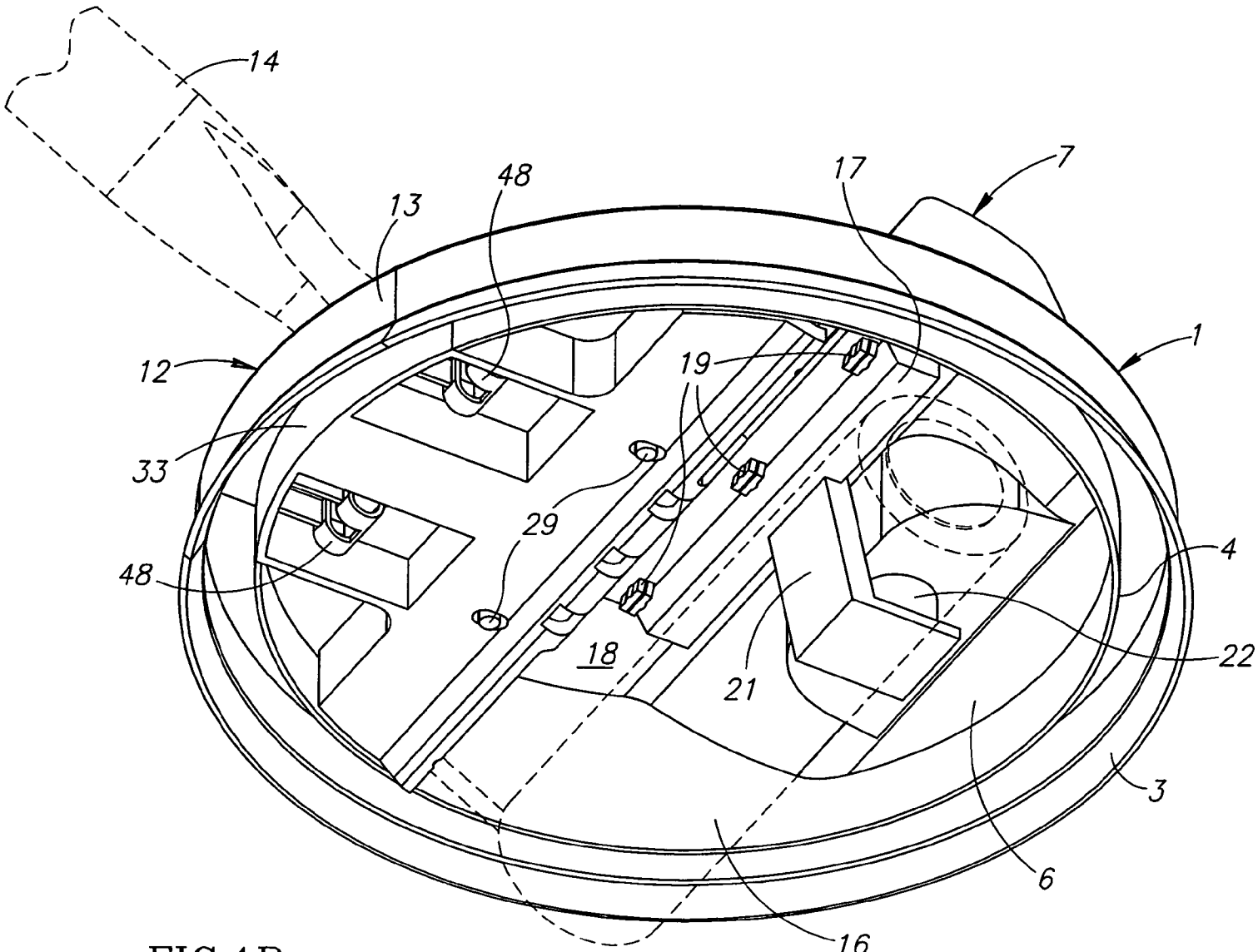
FIG. 1B is an isometric bottom view of the assembled paint roller cleaning apparatus with the paint roller and handle shown in dotted lines.

Referring to FIG. 1A, the paint roller cleaning apparatus is illustrated as being incorporated into a container lid structure indicated generally at 1. Although the lid configuration 1 may be altered in detail to accommodate any size or shape container, the illustrated embodiment is illustrated generally in the form of a standard size circular plastic paint can lid designed to engage the rim of a standard five gallon paint bucket for instance, indicated at 2, with the outer peripheral rim flange 3 of the lid passing down over the outside of the rim of the paint bucket. The amount of downward extension of the rim flange 3 along the side of the bucket may be varied but will be sufficient to insure against any splash during the cleaning operation as will be presently explained. An inner peripheral flange 4 on the lid, as seen in FIG. 1B, will be sized so as to snugly fit the inside diameter of the bucket rim, again for the purpose of preventing any splash from the cleaning operation. It will be understood that the lid 1 may be formed from any number of well known semi-rigid plastic materials and usually formed by injection molding capable of obtaining complex configurations. It will also be understood that, although the present embodiment is described with reference to a unitary molded structure, it is conceivable that at least some of the parts of the lid could be made separately and joined by any number of well known means to form the lid structure to be described. In the present embodiment, the lid 1 includes a generally planar panel 6, an elongated dome 7 connected at one side to a trough like formation 8 on one side and a cut-out area 9 on the opposite side to allow for placing a riser and conduit connection fixture 11 for a purpose to be described. It will be understood, of course, that the surface of the dome 7, the trough 8 and the cut-out 9 in the present embodiment form a continuous unbroken surface with the planar surface of the panel 6. The continuous rim of the lid 1 is completed by the removable roller handle clamping assembly 12 which has an outer rim flange 13 conforming to the configuration of the rim 3 of the lid to form a complete peripheral enclosure when in place as viewed in FIG. 1A. The clamping assembly 12, when in place, holds the paint roller, including its handle 14 and tubular roller 16, in place as shown in FIGS. 1A and 1B during the cleaning operation presently to be described.

Figure 4A:
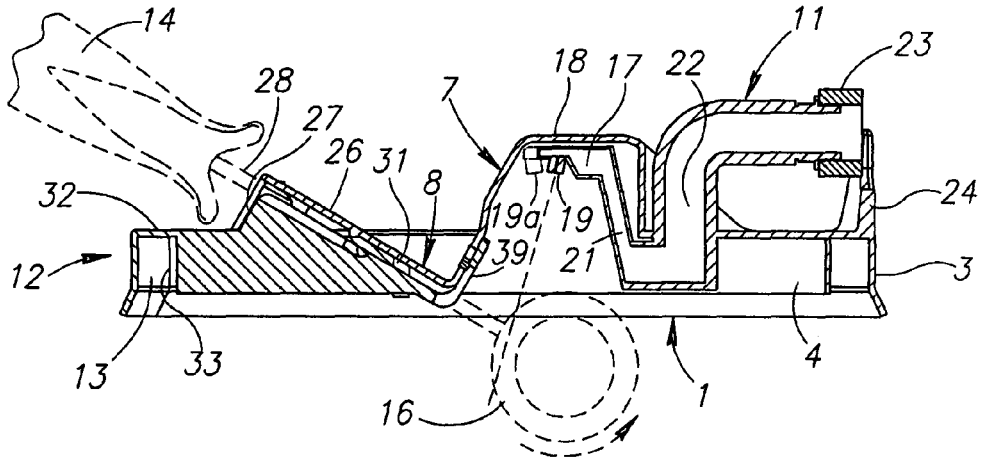
FIG. 4A is cross sectional view taken along lines AA of FIG. 3.
Figure 4B:
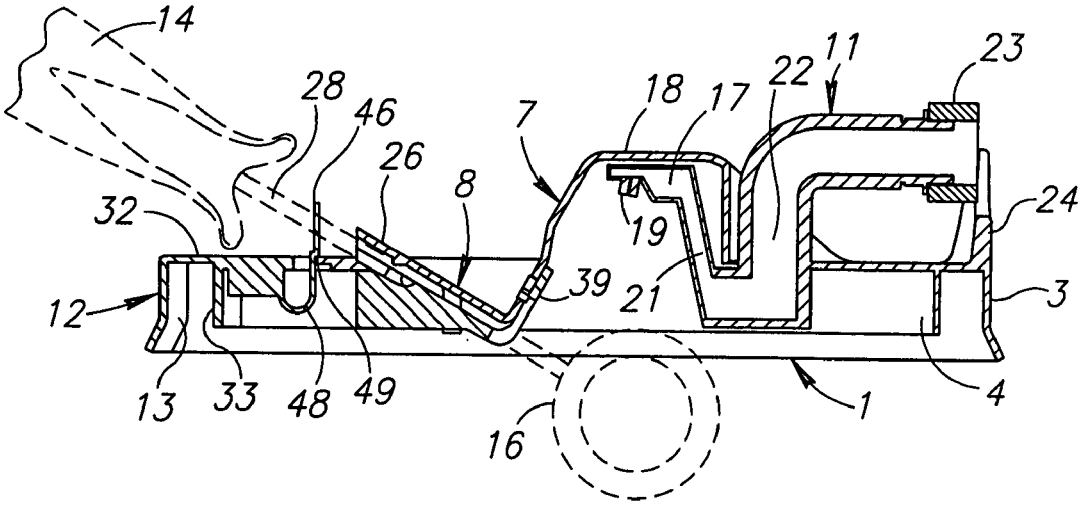
FIG. 4B is an offset cross sectional view taken along lines BB of FIG. 3.

Referring to FIGS. 1B, 4A and 4B, a hollow elongated spray manifold 17 is mounted in fixed position against the surface 18 on the under side of the dome 7. The manifold 17 extends a considerable distance along the length of the dome 7 as shown in FIG. 1B and includes a plurality of jet nozzles 19, three of which are shown in FIG. 1B. These jets may be either of the type for emitting a single high pressure jet or a fan type jet for impacting the surface of the roller 16 to cause a spinning action. As illustrated most clearly in FIG. 4A, the jet nozzle 19 is directed to impact the roller 16 on the left peripheral surface of the roller, as seen in FIG. 4A, to cause a counter clockwise rotation as well be appreciated by those skilled in the art. In the alternative, a jet nozzle 19*a,* shown in dotted lines, may be mounted so as to direct the jet spray to impact the roller on the right hand surface, as seen in FIG. 4A, to impart rotation of the roller 16 in a clockwise direction if so desired. The positioning of the jet nozzles may be in fact adjusted to impact the roller anywhere over a 180° extent of the surface of the tubular roller 16 as desired. Such modification will be understood to be within the scope and intent of the present invention, depending upon which direction the roller is to be rotated. The manifold 17 is connected via the conduit 21 to the riser conduit 22 and a hose coupling or the like 23 which may be adapted for connection to a liquid solvent or air pressure source. A support bracket or shield 24 may be provided on the edge of the planar panel 6 to surround the coupling 23 if desired.

Figure 4C:
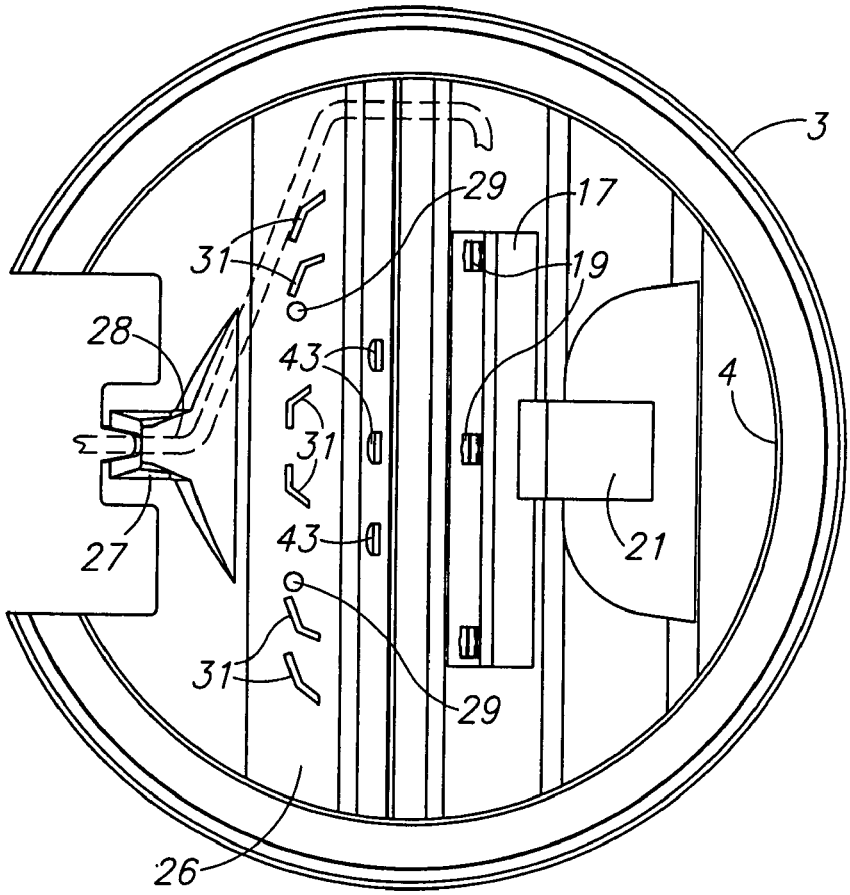
FIG. 4C is a bottom plan view of the lid structure with the roller handle clamping assembly removed to show the surface of the lid.

One side of the trough structure indicated generally at 8 provides a panel 26 with a top surface which extends upwardly and terminates in the handle locator structure 27 for receiving the shaft portion 28 of the handle 14. The trough panel 26 is fitted on its underside with locator lugs or projections 29, as seen most clearly in FIG. 1B, for aiding in locating the roller handle clamping assembly 12 and spacer/locators such as those shown at 31 in FIGS. 4A and 4C for accommodating and locating the handle shaft 28 between the surface of the trough and the clamp assembly 12. As illustrated in FIG. 4C, these locators may be arranged so as to accommodate any roller/handle which may range from 1-9 inch roller size.

Figure 2:
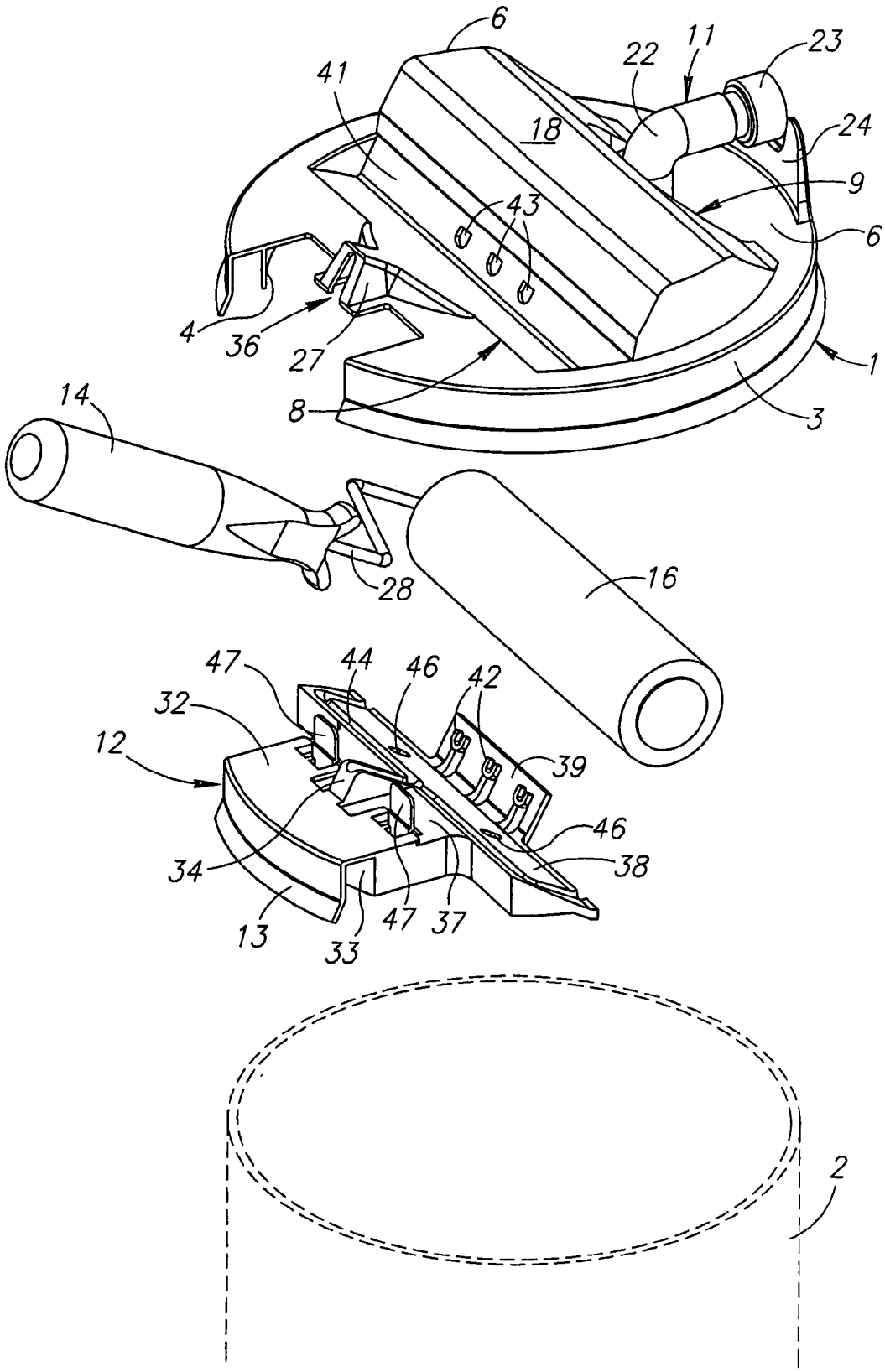
FIG. 2 is an exploded isometric view of a paint roller and the paint roller cleaning apparatus removed from the bucket shown in dotted lines.
Figure 3:
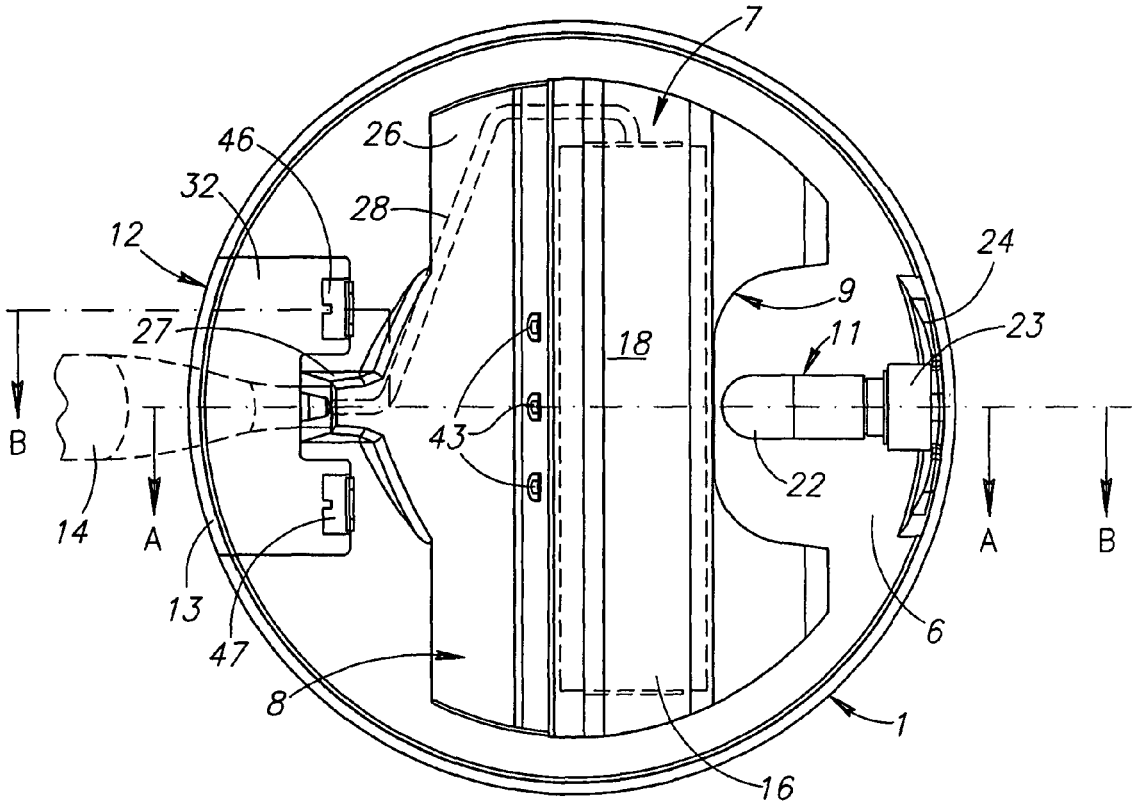
FIG. 3 is a top plan view of the paint roller cleaning apparatus with the paint roller and handle shown in dotted lines.

Referring to FIG. 2, the roller handle clamping assembly 12 may be constructed from a single molding so as to be a unitary structure having the rim section 13 and a planar surface 32 which mates with the planar surface of lid panel 6 when the assembly is in a locked position as shown in FIGS. 1A and 3. Likewise an inner wall 33 of the assembly 12 mates with the inner wall 4 of the lid to form a continuous channel for receiving the rim of a container such as container 2. An upstanding support 34 is positioned so as to enter a slot 36 in the handle locator structure 27 of the lid when the assembly is locked into position as illustrated in FIG. 1A. The clamping assembly 12 further includes a downwardly offset surface 37 for contacting the bottom surface of the lid panel 6 and downwardly inclined surface 38 for cooperating with the underside of the trough surface 26 to hold the roller handle 28 and roller 16 in the locked position. An upwardly inclined surface 39 extends from the surface 38 and engages the back side of the panel 41 and includes a plurality of projections 42 which engage the openings 43 in the panel 41 to position and restrain the clamping assembly 12 to the lid structure. As seen most clearly in FIG. 2, the surface 38 is provided with a channel 44 for receiving the shaft 28 of the roller handle so as to accommodate and position the roller handle either in a right or left hand direction. As seen in FIG. 2, the channel 44 extends from the bottom edge of the surface 38 along its top edge and through the handle support 34. The surface 38 is also provided with two openings 46 which receive the locator lugs 29 on the inside surface of the panel 26 as shown in FIGS. 1B and 4C. These lugs and openings further serve to locate and hold the clamping assembly in the locked position. To complete the structure of the handle clamping assembly, two spring locking clips 47 which are identical in the illustrated embodiment, are molded into the body of the assembly 12. Since these spring clips are identical, only one will be described in detail. As shown most clearly in FIGS. 1B and 4B, each spring clip is provided with a U-shaped segment 48 which connects the thumb tab of the clip to the body of the assembly 12. The plastic material from which the lid is molded is semi-rigid in nature which renders the U-shaped section a living spring hinge. As seen most clearly in FIG. 4B, the upper portion of the clips 47 includes an offset extent providing a shoulder 49 for engaging the top surface of lid panel 6 when the locking assembly is positioned and engaged with the bottom surface of the lid panel. The projections 42 and locator lugs 29 are first engaged as previously described and then the spring clips are snapped into a locked position as shown in the drawings. Prior to snapping the locking assembly into position, of course, the shaft portion 28 of the roller handle will be placed on the panel 26 to locate the roller adjacent the appropriate locator 31 in position to be spun by the fluid jets. The clamping assembly is then engaged and, once the spring clips 47 are in the locked position, the roller 16 is held stationary in the position shown in FIGS. 4A and 4B for the cleaning operation. The jet nozzles 17, 19 may be supplied with any required solvent including water under pressure from such source as a garden hose. Also, the hose connector 23 may be adapted to receive compressed air in the event that fluff drying of the roller is required by means of air jets.

Figure 5:
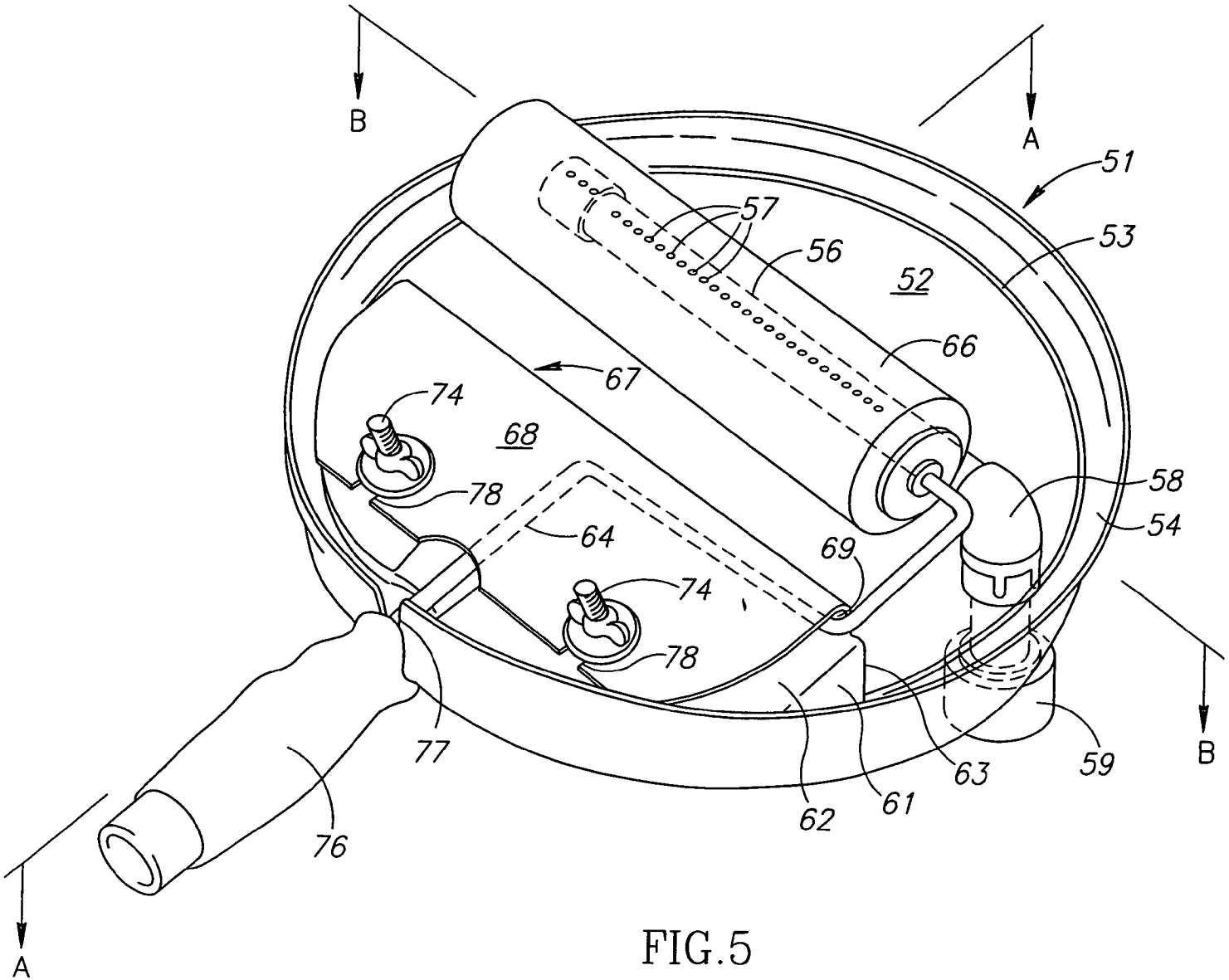
FIG. 5 is a bottom isometric view of a second embodiment of the paint roller cleaning apparatus showing the roller and handle mounted on the bottom surface of the cleaning apparatus lid.
Figure 6A:
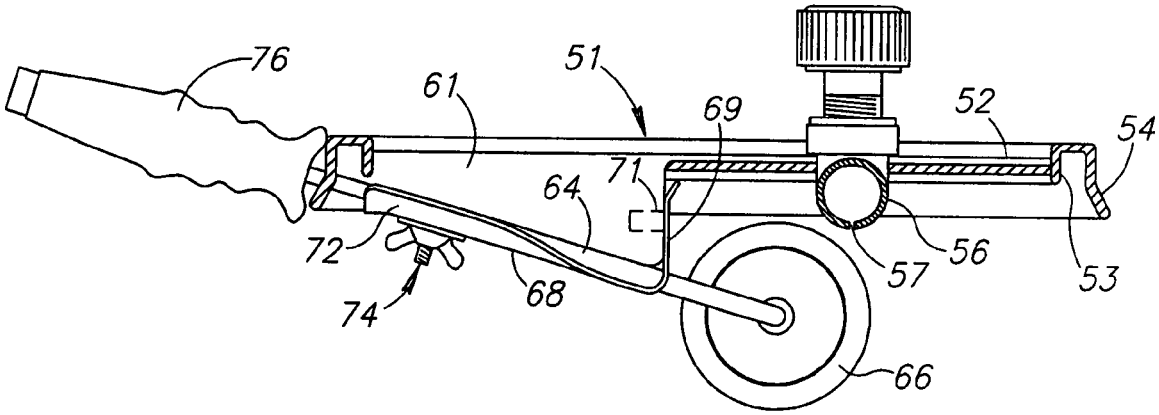
FIG. 6A is a partially sectioned view of the embodiment shown in FIG. 5, taken along lines A-A of FIG. 5.
Figure 6B:
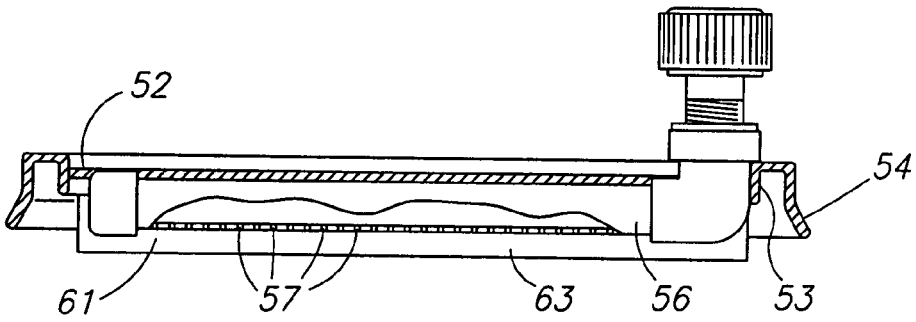
FIG. 6B is a partially sectioned detail of the fluid spray manifold of the embodiment of FIG. 5 taken along lines B-B of FIG. 5.

FIGS. 5, 6A and 6B illustrate a second embodiment of the paint roller cleaning apparatus which includes a lid structure indicated generally at 51 of the type described in the previous embodiment which includes a planar circular panel 52 with inner and outer peripheral rims, 53 and 54 respectively for engaging the top rim of a paint bucket or the like as previously described. In this embodiment the fluid jet spray manifold 56, having a multiplicity of spray orifices 57 along its length, is mounted against the under surface of the panel 52 and connected to a suitable solvent under pressure through the riser 58 and a suitable conduit connector 59 in a well known manner. It will be understood that the riser 58 is rigidly fixed on the lid panel 52 by any suitable means such as plastic welding or adhesive connection. The manifold is thus positioned for producing an array of jet streams downwardly for the purpose of spinning and cleaning a typical paint roller to be described. In order to position or mount the paint roller and handle on the underside of the lid panel 52, a mounting platform 61 is located on the bottom side of the lid panel 52 and may be provided during injection molding of a plastic lid in a manner afore described. The mounting platform 61 includes an inclined surface 62 for receiving the handle shaft 64 of a paint roller and a front vertical surface at 63 as shown in FIG. 6B. The paint roller which includes a conventional handle shaft 64 and tubular paint roller 66 rests on the top surface 62 of the mounting platform 61 so as to position the roller 66 for cleaning. The jet sprays from the orifices 57 strike the roller surface in a tangential manner so as to rapidly spin the roller for cleaning. In order to clamp the roller handle in fixed position, a handle clamping plate 67 overlies the handle shaft 64 and is connected to the mounting platform 61. As shown in FIGS. 5 and 6A, the plate 67 is generally L-shaped with a generally planar flange 68 for contacting the handle shaft 64 and downwardly extending flange 69 which engages the front face 63 of the mounting platform 61. In order to position and retain the clamping plate 67 against the surface 63, one or more tabs or projections 71 are provided on the flange 69 and will engage a corresponding number of openings (not shown) in the front face 63 of the mounting platform as shown in FIG. 6A. The otherwise planar surface of the flange 68 may also include a rounded channel formed in its surface as at 72 to insure against lateral movement of the handle shaft 64 during the cleaning operation. The clamping plate is held in position by tightening fasteners such as conventional thumb screw units 74.

In order to mount the paint roller in position for cleaning, the lid 51 is positioned upside down as shown in FIG. 5, the roller handle shaft 64 is laid on the surface 62 of the mounting platform with the hand grip 76 resting against the flange 54 and the handle shaft 64 passing through the slotted opening 77 of the flange. With the roller handle in position, the L-shaped clamping plate is engaged on the mounting platform 61 as described by inserting the projections 71 into the holes in the front face 63 of the mounting platform. As the clamping plate is moved into position, suitable slots 78 in the flange 68 of the clamping plate straddle the screw threaded members of the thumb screw units 74 and the plate is then clamped in position by operating the thumb screws. The device is then ready for mounting on a suitable bucket or other support for spinning and cleaning by the jet sprays.

Although the present invention has been described with reference to preferred embodiments, it will be apparent that alternative structural or mechanical details may be employed in order to accomplish the objects of the invention. As an example, different materials of construction may be employed as well as types of fasteners and connecting members as well as details of configuration of the various parts. Different types of solvent and/or compressed air sources may be utilized and the jet spray configurations may be varied without departing from the spirit and scope of this invention.

What is claimed is:

1. In a cleaning system for a handle mounted roller applicator, said system having a support member and a lid therefor, the combination comprising;

a lid structure having a bottom side for mounting a pressure fluid jet stream manifold thereon, a clamping assembly for clamping a roller handle shaft to the bottom side of said lid with the roller positioned for spinning responsive to fluid jet impact from said manifold, releasable positioning and attachment means for holding said clamping assembly in engagement with said lid, and means for mounting said lid on a support, whereby said lid structure provides the sole mounting for said roller and said fluid jet stream manifold.

2. Roller cleaning apparatus comprising;

a lid structure having a top side, a bottom side and a rim channel for engaging a support member, means for mounting a pressure fluid jet manifold on the bottom side of the lid structure with a riser connector extending above the top side thereof for connection to a fluid pressure source, and a releasable clamping assembly for clamping a roller handle shaft to the bottom side of said lid structure with the roller positioned for spinning responsive to fluid jet impact from said manifold, whereby the lid structure provides the sole mounting for the roller cleaner.

3. The apparatus of claim 2 wherein said lid structure includes a planar section for mounting said riser connector.

4. The apparatus of claim 3 wherein said roller handle shaft extends exterior to said lid structure.

5. The apparatus of claim 4 wherein said fluid jet manifold is elongated and includes a plurality of jet nozzles along the length of a roller clamped in said lid structure.

6. The apparatus of claim 5 wherein said lid structure includes a downwardly inclined surface on its bottom side for mounting said roller shaft.

7. The apparatus of claim 6 wherein said clamping assembly includes projections engaging openings in said lid structure for holding and positioning said clamping assembly against the lid structure.

8. A roller cleaner comprising;

a lid panel including a top side, a bottom side and a peripheral channel for receiving the rim of a support member, a housing incorporated into and contiguous with said lid panel extending upwardly from said top side, a trough structure incorporated into and contiguous with said lid panel extending downwardly from said bottom side, said trough providing first and second opposed bottom surfaces, said lid panel including a segmental opening in the periphery thereof adjacent said trough, a detachable roller handle clamping assembly conforming to the shape of said segmental opening, said clamping assembly further including a first surface cooperating with the first bottom surface of said trough and a second surface extending at an angle therefrom for contacting the second bottom surface of the trough, locator means on said first and second surfaces of said clamping assembly and said trough for locating and retaining said clamping assembly in engagement with the lid panel, releasable fastener means on said lid panel and said clamping assembly to lock said assembly to said lid panel when said locator means are engaged, whereby a roller handle may be clamped between the first surface of said trough and the first surface of said clamping assembly with a roller on said handle located below and parallel to said housing, and a pressure fluid jet manifold mounted in said housing for directing jet streams against said roller to spin, wash and dry said roller.

9. The apparatus of claim 8 wherein said lid panel is generally planar, said housing is elongated and convex for mounting said manifold above a roller mounted in said lid panel.

10. The apparatus of claim 9 wherein said trough is elongated and concave and extends adjacent and parallel to said housing.

11. The apparatus of claim 10 wherein said clamping assembly includes a planar top surface contiguous with the top side of said lid panel and a channel contiguous with said lid channel.

12. The apparatus of claim 11 including;

a plurality of spaced projections on the first bottom surface of said trough for accommodating different configurations of roller handle shafts.

13. A roller cleaner comprising;

a lid panel including a top side, a bottom side and a peripheral channel for receiving the rim of a support member, a pressure fluid jet manifold mounted on the bottom side of said lid panel with a riser connector means for connecting to a source of pressure fluid, a mounting platform on the bottom side of said lid extending parallel to said manifold, said mounting platform including a first surface inclined downwardly in the direction of said manifold and a second surface extending upwardly therefrom, and a clamping assembly having first and second surfaces for contacting the first and second surfaces respectively of said mounting platform, projections extending between the second surfaces of said mounting platform and said clamping assembly respectively for positioning and holding said clamping assembly in position on said mounting platform, and releasable fastening means for clamping said assembly against said mounting platform when said projections are engaged, whereby a roller handle shaft may be clamped between said mounting platform and said clamping assembly with a roller on said handle shaft located below and parallel to said manifold for spinning, cleaning and drying by said fluid jets.

14. The apparatus of claim 13 wherein said lid panel is planar and said peripheral channel extends completely about the periphery of said lid panel.

15. The apparatus of claim 14 wherein said roller handle shaft extends exterior to said lid structure.

16. The apparatus of claim 15 wherein said fluid jet manifold is elongated and includes a plurality of jet nozzles along the length of a roller clamped in said lid panel.

17. The apparatus of claim 16 wherein said clamping assembly includes a channeled extent contacting a portion of the roller handle shaft to prevent displacement thereof.

* * * * *